United States Patent [19]

Kawamura

[11] 4,219,793

[45] Aug. 26, 1980

[54] FUSE WITH PLANAR FUSE ELEMENT

[75] Inventor: Isao Kawamura, Ohgaki, Japan

[73] Assignee: Pacific Engineering Co., Ltd., Ohgaki, Japan

[21] Appl. No.: 866,624

[22] Filed: Jan. 3, 1978

[30] Foreign Application Priority Data

Jan. 31, 1977 [JP] Japan ..... 52/10903[U]

[51] Int. Cl.[2] ..... H01H 85/08

[52] U.S. Cl. ..... 337/228; 337/295

[58] Field of Search ..... 337/290, 295, 231, 227, 337/228, 159, 241

[56] References Cited

U.S. PATENT DOCUMENTS

| | | | |
|---|---|---|---|
| 761,675 | 6/1904 | Hartwig | 337/231 |
| 1,441,550 | 1/1923 | Weston | 337/295 |
| 1,478,109 | 12/1923 | Ellison | 337/290 |
| 2,313,373 | 7/1942 | Sundt | 337/295 |
| 2,662,952 | 10/1951 | Nivoix | 337/290 |
| 2,682,587 | 6/1954 | Burt et al. | 337/295 |
| 2,773,961 | 4/1956 | Sundt | 337/295 |
| 2,828,390 | 3/1958 | McAlister | 337/295 |
| 3,394,334 | 7/1968 | Wright et ai. | 337/241 |
| 3,909,767 | 9/1975 | Williamson et al. | 337/295 |

FOREIGN PATENT DOCUMENTS

| | | | |
|---|---|---|---|
| 1330776 | 7/1962 | France | 337/295 |

*Primary Examiner*—Harold Broome

[57] ABSTRACT

A fuse comprises a slender tube, a fuse element installed therein and terminals attached to both ends of the tube, wherein said fuse element being characterized by a plate substance having supporting sections extended respectively from each end of a fusing section, said supporting sections connected electrically to each terminal and said fusing section being bent at least at one part thereof.

4 Claims, 5 Drawing Figures

FUSE WITH PLANAR FUSE ELEMENT

The present invention relates to a fuse applied for preventing damages to electric apparatus, electric circuit elements, ect., particularly to those used for automobiles.

The electric apparatus and circuits used for automobiles are generally operated under low voltage such as 12 V for example. The fuse applied for protecting such low voltage electric apparatus and circuit elements is comprising a cylindrical glass tube with a flat fuse element sealed therein having metal terminals at both ends of the tube to be connected electrically. These low voltage use fuses are generally called as cartridge fuse.

The fuse of this type is a kind of breaker and is installed on a power feeder of electric circuit in order to cut off the power supply to the electric circuit by melting the fuse element by Joule heat generated when an excess current flows in the power feeder due to short circuit or overload. Thus it contributes to prevent the damage of electric apparatus and circuit elements as well as prevent abnormal power consumption. Therefore severe characteristics are required for the fuse of this type to secure the achievememt of the above-mentioned function.

Among characteristic requirements, the fusing characteristic is a decisive factor for deciding the excellence of the fuse and particularly in order the fuse to be used as a quick acting fuse, it is desired to act so that the power feeder circuit is cut off as short time as possible responding to the excess current at once. In the quick acting fuse, the danger of electric apparatus and circuits as well as abnormal power consumption may be prevented substantially by satisfying such fusing characteristic as abovementioned.

Also depending on using or not using the electric apparatus and circuits to which the fuse of this type is applied, power feeding to them is performed intermittenly through the fuse. The fuse is also required to have a mechanical deterioration characteristic during long period that is durability for such a dynamic application as above mentioned. Generally the fuse does not substantially be caused to fuse by normal operation of the electirc apparatus and circuits, however it is constructed to have such a specified resistance value and fusing temperature as to cause fusing by heat generation in abnormal operation. Consequently, even in normal operation, Joule heat based on the resistance value is generated in the fuse element by which fuse element is more or less subjected to chemical, physical and mechanical effects. Especially when electric current intermittently flows in the fuse element depending on using or not using the apparatus and circuits, Joule heat is generated intermittently, consequently the Joule heat causes to heat the fuse element intermittently in relation to the heat constant of the fuse element. The intermittent heating comparing to the continuous heating gives more physical the mechanical effects to the fuse element. Among these effects, expansion and contraction of the fuse element caused by thermal change will produce a repeated mechanical strain to the fuse element. The repetition of the mechanical strain gives mechanical fatigue to the fuse element which initially produces partial cracks therein and finally causes the fuse element to be broken.

The durability has an interrelation with quick acting preformance of fusing characteristic and generally improvement of the durability will cause to decrease the quick acting performance, whereas improvement of quick acting performance will cause to decrease the durability.

Also the fusing characteristic and durability of the fuse applied to the electric circuit for automobile acutally have a certain allowing range and are specified as follows for example. As a fusing characteristic:

(1) Shall fuse within 15 seconds at 150% of the rated current.

(2) Shall fuse with one hour at 135% of the rated current.

(3) Shall not fuse at 110% of the rated current.

As durability:

(4) Shall be able to repeat more than 50,000 times with 10 second application of 70% rated current and 10 second breaking as one time.

Therefore the fuse shall be constructed to satisfy the above mentioned specifications. However conventionally it was very difficult to obtain a fuse which has such a fusing characteristic as to fuse instantly by the overcurrent nearly close to the no-fusing current specified in (3) and has durability as specified in (4). Consequently the durability of the fuse is secured sacrificing substantially its quick acting performance to some extent. Also the durability specified in (4) is not sufficient as an actual requirement. At present more higher performance is required such as allowing repeated current application at least 100,000 times.

It is an object of this invention to improve the durability of the fuse without sacrificing its quick acting performance.

Other object of this invention is to improve the durability as well as quick acting performance substantially.

The fuse according to this invention is comprising a slender tube, a fuse element installed therein and terminals attached to both ends of the tube. Also the fuse element is comprising a plate type substance having a fusing section and supporting sections extending from the fusing section to both ends of the fuse element. These supporting sections are connected electrically to each terminal respectively. The fuse, at least a portion thereof is bent to absorb the thermal expansion and contraction of the fusing section.

Also the tube preferably is of glass made and is formed into a cylindrical shape. And if desired, it may be made of heat resisting hard plastics or porcelain. Further the tube may be made to be transparent with use of these materials. In this case, since the tube inside becomes visible, it is possible to confirm whether the fuse element is blown out or not. The tube is open at both ends longitudinally from which the fuse element is inserted therein.

The fuse element is made of zinc or of alloy comprising zinc, copper and titan or alloy comprising zin, copper and magnesium or alloy comprising zinc, magnesium and cadmium. They are decided based on fusing characteristic and durability. Both supporting sections of the fuse element and terminals provided at tube ends are soldered with alloy comprising zinc and tin to be connected electrically. The terminals consist of electric conductive material such as brass for example to which surface nickle coating is applied preferably.

The supporting sections according to this invention are preferably shaped into a rectangular shape and the fusing section is formed to be narrower in width than the rectangular shaped supporting section as well as being curved in the same flat plane as that of supporting sections. The fusing section may also be bent so as to describe a circular arc nearly perpendicular to the wide flat plane of the supporting sections.

Further the narrow fusing section is preferably extended from a tip located almost in the middle of each supporting section end. On the other hand, the narrow fusing section may be extended from the upper part and the lower part respectively of each supporting section end as occasion demands.

Referring now to the embodiment of the present invention in accordance with the drawings. The aforementioned objects and features of this invention as well as other objects and features thereof will be apparent from the embodiment described below.

Figure 1:
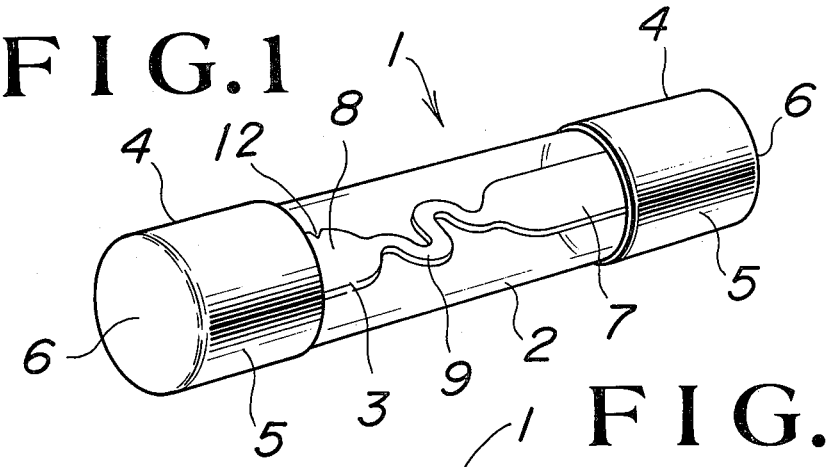
FIG. 1 is a perspective view of an embodiment of the fuse according to this invention.
Figure 2:
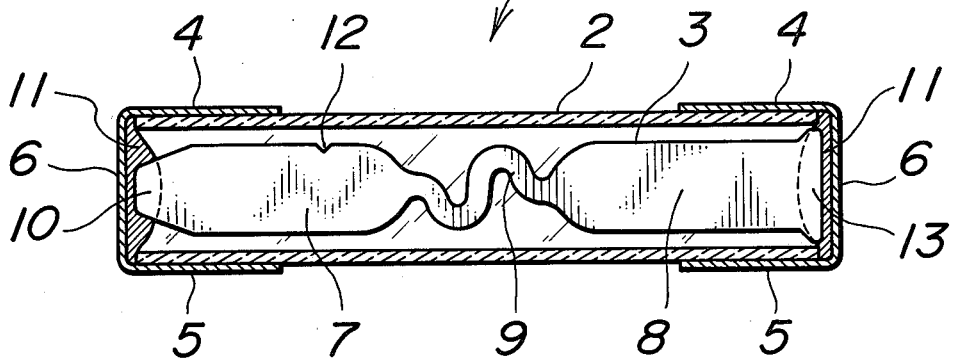
FIG. 2 is a sectional side elevation of the fuse shown in FIG. 1.
Figure 3:
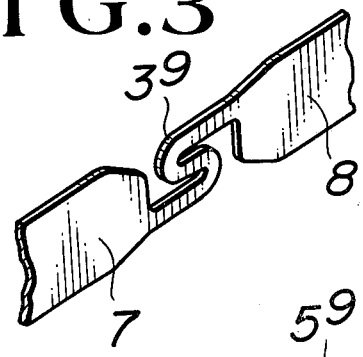
FIG. 3 is an explanatory view of a modified embodiment of the fuse element shown in FIG. 1.
Figure 4:
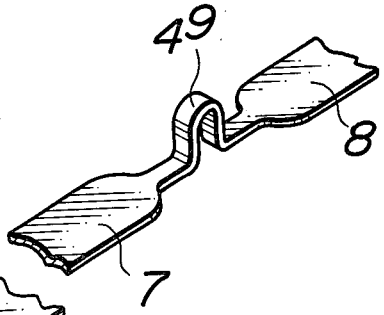
FIG. 4 is an explanatory view of another modified embodiment of the fuse element shown in FIG. 1.
Figure 5:
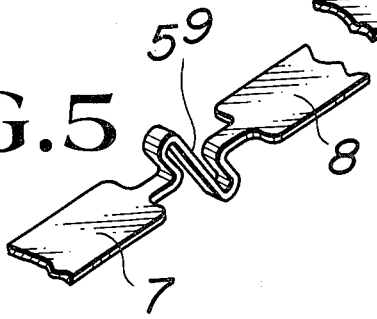
FIG. 5 is also an explanatory view of another modified embodiment of the fuse element shown in FIG. 1.

Referring to FIGS. 1 and 2 of the drawings wherein a fuse 1 is formed into a slender and cylindrical tube and a fuse element 3 is inserted in the transparent cylindrical glass tube 2. The tube 2 is open on both longitudinal ends to which metal caps 4 are attached respectively. The metal caps 4, cylindrical side surface 5 and disc end plates 6 form an integral construction. The metal caps 4 form the terminals through which electric current is supplied to the fuse element 3. Also the caps 4 are placed so that the openings at both ends are closed, thereby entrance of foreign matters such as dust, water, etc. into tube inside 2 may be prevented. Therefore a suitable adhesives is applied on the connecting surfaces between the tube 2 and caps 4 so that they do not easily separate each other. The fuse element 3 comprises a longly extending flat plate. The fuse element 3 comprises two rectangular supporting sections 7 and 8 provided at both ends thereof and a fusing section 9 formed integrally with two supporting sections 7 and 8. The supporting section 7 is formed so that it becomes gradually narrow toward its pointed end 10 which is connected electrically to the metal cap 4. In order to achieve electric connection, a solder 11 is applied between metal cap 4 and pointed end 10. By this electric connection, the fuse element 3 is firmly supported by the metal cap 4 at this end. The supporting section 7 is provided with a notch nearly in the center of a side extending longitudinally which can be seen through the transparent tube 2. The notch is provided for giving visibility of the state at tips of both supporting sections 7 and 8 which becomes invisible after the completion of fuse assembling. The supporting section 7 is further extended from the notch 12 and then is narrowed in width gradually to be connected to the fusing section 9. The fusing section 9 is bent concavely describing the first arc with a width almost equal to the narrow width of the supporting section 7 and then is bent convexly describing the second arc with the same width as mentioned above. As the result, the fusing section is formed in a wave form. These two arcs are present in a flat wide plane including the supporting sections 7 and 8. The width of the fusing section 9 is decided depending on such elements as material of plate substance, thickness of plate substance, substantial length of the fusing section, fusing characteristic, durability, etc. The fusing section 9 bent as mentioned above may alternatively be formed as shown in FIG. 3. In this case, the fusing section 39 is extended straight toward the supporting section 8 from the lower end of the supporting section 7 with the width narrower than that of the supporting section 7, and then is extended reversely toward the supporting section 7 describing the first convex arc against the supporting section 8 and then describing the convex arc against the supporting section 7 to be connected to the upper end of the supporting section 8. As the result, the fusing section is formed substantially in a S-shaped form. The connecting sections between the fusing section 39 and the supporting sections 7 and 8 are positioned almost parallel each other and placed upper and lower without interfering each other. The fusing section of such construction will enable to lengthen the supporting section (39) length substantially absorbing mechanical strain thereof without increasing the distance between the supporting sections 7 and 8 as well. Further the fusing section may be formed as shown in FIG. 4. The fusing section 49 is so formed that each supporting section 7 and 8 is extended straight toward the supporting sections 8 and 7 respectively from a nearly central part thereof and then is bent perpendicularly to the flat wide plane including the supporting sections 7 and 8 nearly at the middle between said supporting sections and then is curved to describe an arc to be connected each other at the top of each curve. As the result, the section of the fusing section is formed in a U-shaped form. Further the fusing section may be formed as shown in FIG. 5. In this case, the fusing section 59 is so formed that two arc tops such as the fusing section 49 shown in FIG. 4 are placed opposite to each other without overlapping one another and then one end of each arc is connected together and the other end is connected to each supporting section. In this case, the fusing section may also be bent with a slight gradient to the flat plane including the supporting sections 7 and 8. The fusing section is formed nearly at the center of the tube 2 which is not covered by the cap 4, therefore the fusing section is visible through the tube 2 which enables to ascertain the fusion of the fusing section from the outside.

Turning now to FIG. 1 and FIG. 2 wherein the supporting section 8 is formed almost similar to the supporting section 7. However the notch 12 is not provided at the supporting section 8. It is sufficient if the notch is provided at either one of the supporting sections. The end 13 of the supporting section 8 has projections projecting laterally and is formed to be a little wide. The solder 11 is applied to the space between the wide end 13 and the metal cap 4 by which they are connected electrically, at the same time the fuse element 3 is supported by the metal cap 4 at this end. The color painting may be applied to the supporting section 7 and/or 8 giving such color as red, blue, black, etc. in accordance with fuse rating. By applying color to the supporting section which is visible through the tube 2, it becomes easy and convenient to recognize the fuse rating, that is the current capacity at once. Also by making the supporting section wide, it contributes to increase the mechanical strength as well as serving as a radiation plate and it does not cause to heat excessively the fusing section under normal use of the apparatus, therefore mechanical strain applied to the fusing section becomes small. The fuse formed as above mentioned is for example 6. 4 mm in diameter, 30 mm in length, about 0.1 mm in fuse element thickness and about 8 mm in substantial length of the fusing section.

What is claimed is:

1. A fuse of a quick performance comprising (a) a slender transparent tube, (b) cap terminals provided at both ends of said tube so as to close said opening ends, (c) a generally planar fuse element wherein said cap terminals are connected and which is inserted into said tube, wherein a planar fusing section is longitudinally provided nearly at the center and coplanar and generally rectangle supporting sections integrally extend on the terminal's side from said fusing section and are fixed on each cap terminal, the breadth of the planar surface of the fusing section is narrower than that of the supporting sections, the breadth of both supporting sections becomes gradually narrower and each supporting section has curvilinear sides and is united nearly at the center of its one side to the fusing section, and the fusing section is formed having a smooth S shape with two arcs on the same plane as the coplanar wide surface of the supporting section, whereby a strain generated in a fuse element by the thermal expansion and contracion is equally absorbed in the S-shaped fusing section.

2. A fuse of a quick performance according to claim 1 wherein one side of one supporting section fixed on the cap terminal is wider in breadth than other part thereof and one side of the other supporting section is narrower in breadth than other part thereof.

3. A fuse according to claim 2 wherein the tube in transparent and the other supporting section is provided a visible notch by means of said transparent tube.

4. A fuse according to claim 1 wherein the tube is transparent and the supporting section is colored corresponding to the current capacity.

* * * * *